US006468165B1

(12) United States Patent
Moore

(10) Patent No.: US 6,468,165 B1
(45) Date of Patent: Oct. 22, 2002

(54) MILLENN GOLF

(76) Inventor: Sherrod F. Moore, 1195 Kamehame Dr., Honolulu, HI (US) 96825

( * ) Notice: Subject to any disclaimer, the term of this patent is extended or adjusted under 35 U.S.C. 154(b) by 0 days.

(21) Appl. No.: 09/706,546

(22) Filed: Nov. 6, 2000

(51) Int. Cl.[7] ..... A63B 69/36

(52) U.S. Cl. ..... 473/170; 473/172; 473/196; 473/16; 473/5

(58) Field of Search ..... 473/169, 170, 473/172, 195, 196, 197, 185, 168, 180, 281; 273/398–402

(56) References Cited

U.S. PATENT DOCUMENTS 1,211,379 A * 1/1917 Maisch ..... 273/368
1,923,152 A * 8/1933 Kohn ..... 273/394
2,009,759 A * 7/1935 Brown ..... 473/575
3,198,526 A * 8/1965 Smith et al. ..... 473/200
3,216,728 A * 11/1965 Whitney ..... 273/127 B
3,348,846 A * 10/1967 Atchison ..... 273/400
3,467,388 A * 9/1969 Weiler ..... 273/123 R
4,776,596 A * 10/1988 Nojima ..... 473/165
5,395,122 A * 3/1995 Kraemer ..... 273/400

* cited by examiner

*Primary Examiner*—Mark S. Graham
(74) *Attorney, Agent, or Firm*—Thomte, Mazour & Niebergall

(57) ABSTRACT

Millenn Golf is a recreational form of golf played indoors or outdoors in a yard, field, gymnasium or basketball court or other hard surface, in which players use ordinary golf clubs to strike the Nium Flyer from a portable strip of synthetic turf, causing the Nium Flyer to fly toward a goal called the Netty Millenn in the fewest number of strokes until the Nium Flyer lands in and rests in the Netty Millenn. Each player then removes the Nium Flyer, places it on the synthetic turf and proceeds to repeat the game process completing the course as determined by the players and/or the game master. The object of the game is to complete the course in the fewest strokes as possible as in regular golf. The player with the fewest strokes, as in regular golf, is the winner. Millenn Golf is an economical, portable and flexible form of golf which can be enjoyed by people of differing ages in all types of weather, even indoors. It also has sporting and recreational challenges which are different yet similar to regular golf.

13 Claims, 15 Drawing Sheets

MILLENN GOLF

BACKGROUND OF THE INVENTION

The present invention relates to a recreational form of golf played in the yard, field, gymnasium, or basketball court whether indoors or outdoor and provides a portable golf game which can be used indoors and outdoors where no other traditional golf can be played. Millenn Golf is designed to be a more economical and challenging way of golfing than regular golf, yet it is complementary to regular golf and any derivatives thereof.

Several innovations for the game of golf have been devised. Although these innovations exist, they do not provide as suitable, economical and a challenging method of portable golf as the present invention. Millenn Golf is a flexible yet challenging indoor and outdoor game which may be played by people of differing ages with enjoyment, entertainment and variety without great expense.

SUMMARY OF THE INVENTION

It is the object of the present invention to provide a portable golf game to be used indoors and outdoors where traditional golf may not be played. It is designed to be a more economical, challenging and simpler form of golf, yet it is complementary to traditional golf and any derivatives thereof. In Millenn Golf, each player uses an ordinary golf club to strike the Nium Flyer from a portable strip of synthetic turf, causing the Nium Flyer to soar into the air towards or into the Netty Millenn in the fewest number of strikes of the Nium Flyer with the golf club as possible until the Nium Flyer lands into and rests in the Netty Millenn. Each player then removes the Nium Flyer from the Netty Millenn and proceeds to repeat the game process to any number of Netty Millenn in the course as determined by the players or game master for the day. The player with the fewest strokes, as in regular golf, is the winner. Alternatively, points may be used and assigned for successfully landing the Nium in the upper or lower Netty Millenn, depending upon the particular game chosen at that time by the players or game master. The course may consist of one or more Netty Millenn as deemed necessary and desirable by the players and/or the game master for the day.

The players may choose from any one of four Nium Flyers in playing Millenn Golf. Unlike regular golf, where up to 14 clubs are available to be used with the same ball, the Millenn golfer uses only two clubs, a driver and/or a lofted iron, and may choose any one of the four Nium Flyers. There are two Velo Niums, the small size and the large size. The other two Nium Flyers are called Stealthy Nium and SC Nium. The players or the game master for the day decides which Nium Flyer is to be used for a particular game. Likewise, the players and/or the game master for the day decides the points given for the goal achieved before the start of any particular game being played. All participants must agree on the rules and points of the game in advance. The game master for the day is responsible for all rule making and decisions on rule contests and scoring disputes, if any. The players are responsible for their own correct scoring. Velo Nium, small size, is a dimpled vinyl and/or plastic object in the shape of an American-type football. It is 78 millimeters (mm) in diameter and 104 mm long. It has plastic wing-fins inserted in the rear of the object around a plastic shaft/tube which is 3.6 mm in diameter and 78 mm in length. The small Velo Nium is lighter than the larger one and is suggested for use by children.

Velo Nium, large size, is a dimpled vinyl and/or plastic object in the shape of an American-type football. It is 126 mm in diameter and 168 mm in length. It has plastic wing-fins inserted in the rear of the object around a plastic shaft/tube. The total weight of this object is approximately 80 grams.

Stealthy Nium is a dimpled vinyl and/or plastic ball which is 42 mm in diameter. It has plastic wing-fins inserted into the ball around a plastic shaft/tube. The overall length of Stealth Nium is 110 mm, and the maximum width is 78 mm.

SC Nium is a dimpled vinyl and/or plastic ball which is 42 mm in diameter, with a total overall length of 110 mm. It is a one-piece injection-blow-molded object. SC Nium is unique, with a 360° spinning solid wing-hub assembly, to which is attached the solid plastic wing. The wingspan diameter is 80 mm. SC Nium comes in many bright and pastel colors for multiplayer identification purposes.

The Netty Millenn is composed of an umbrella like frame with doubled fabric netting on the base of the inverted umbrella with a smaller upper net, topped by the Millenn Golf Flag, all of which constitute the goal of the people playing Millenn Golf.

The Netty Millenn may be deployed in either the single net or the double net format and may either be inserted into the metal spike which is driven into the ground, or it may be mounted on the 30 mm base plate for used on hard surfaces.

The players use either a driver or an ordinary lofted golf clubs in striking the Nium Flyer which rests on a strip of synthetic turf at the start of the stroke by the player. After the stroke is played, the player then carries the strip of synthetic turf to the location of the Nium Flyer, places the Nium Flyer on the synthetic turf and repeats the process until the Nium Flyer comes to rest in the netting of the Netty Millenn.

Millenn Golf can be played almost anywhere in all kinds of climates on just about any kind of surface. Millenn Golf is environmentally friendly, demanding, and leaving little or no damage to the area where it is played. In playing Millenn Golf, the players must use a strip of synthetic turf as a launching mat. The launching mat is 400 mm×200 mm×20 mm. The launching mat is green with white letters down the center to guide the stroke being played by the player to avoid damage to the surface upon which Millenn Golf is being played. The letters on the launch mat are as follows in a line down the center of the green launch pad: ENVIR♡NMATTLENN. The launch mat also is lettered with a white Japanese katakana with the same name as in English letters. Millenn Golf is designed to be enjoyed by all ages across all cultures, all of which is environmentally friendly yet demanding.

BRIEF DESCRIPTION OF THE DRAWING FIGURES

LIST OF REFERENCE NUMERALS UTILIZED IN THE DRAWINGS

Figure 1:
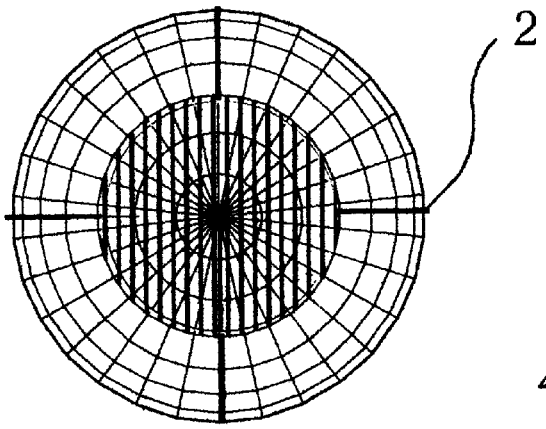
FIG. 1 is a plan perspective view of the Netty Millenn with both upper and lower net in the fully opened position.

1—Base plate assembly
2—Lower net
3—Flag
4—Upper net
5—Upper frame tube
6—Lower frame tube
7—Net rib
8—Pointed spike
9—Upper net rib
10—Net rib mounting strip
11—Pivot
12—Lower clamp
13—Upper clamp
14—Upper net rib mounting strip
15—Pivot
16—Lower frame tube shoulder
17—Lower frame tube insert tube
18—Pointed ground spike shoulder
19—Pointed spike tube
20—Base plate
21—Base plate tube
22—Lower umbrella snap strap
23—Upper umbrella snap strap
30—Ball
31—Badminton-style fairing
32—Openings in 31
33—Threads in 30
34—Thick base of 31
35—Screw/shoulder screw
36—Tapered wall in 31
37—Hole in 31
38—Spherical housing in 31
39—Unitized ball
40—Four wing-fin arrangement
41—Center tube/rod
42—Tube/rod end
43—Three wing-fin arrangement
44—Recess on wing-fin edge to expose more side
45—Recessed edge in 43
46—Upper portion of football-type head
47—Lower portion of football-type head
48—Wing-fin
49—Center tube/rod
50—Football-type head broadside
51—Recess
52—Recessed edge of wing-fin
53—Tube/rod end

DETAILED DESCRIPTION OF THE PREFERRED EMBODIMENTS

This detailed description of FIGS. 1 through 34 refers to the figures by number in describing the physical objects used in playing Millenn Golf. In describing the figure numbers, the numbers referenced in the following paragraphs without the word FIG refer to the reference numerals itemized in the drawing figures.

Figure 2:
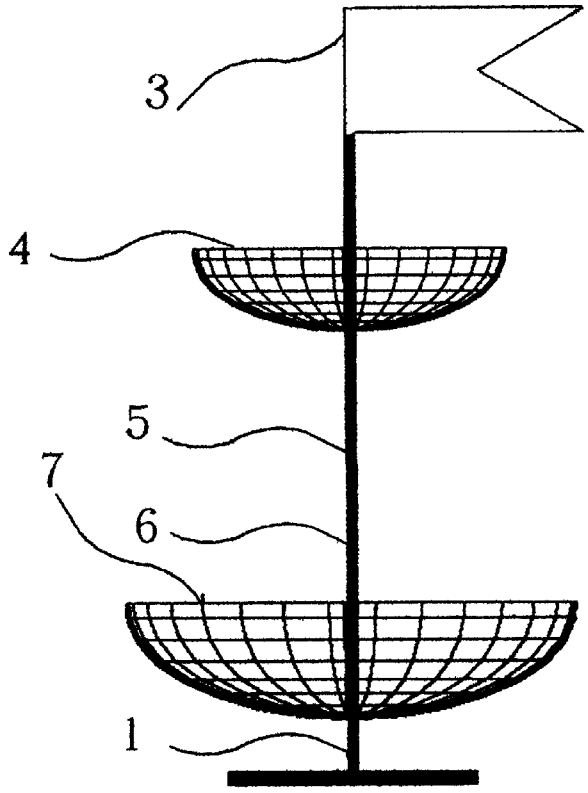
FIG. 2 is the elevation view of the Netty Millenn with both upper and lower net in the open position.
Figure 3:
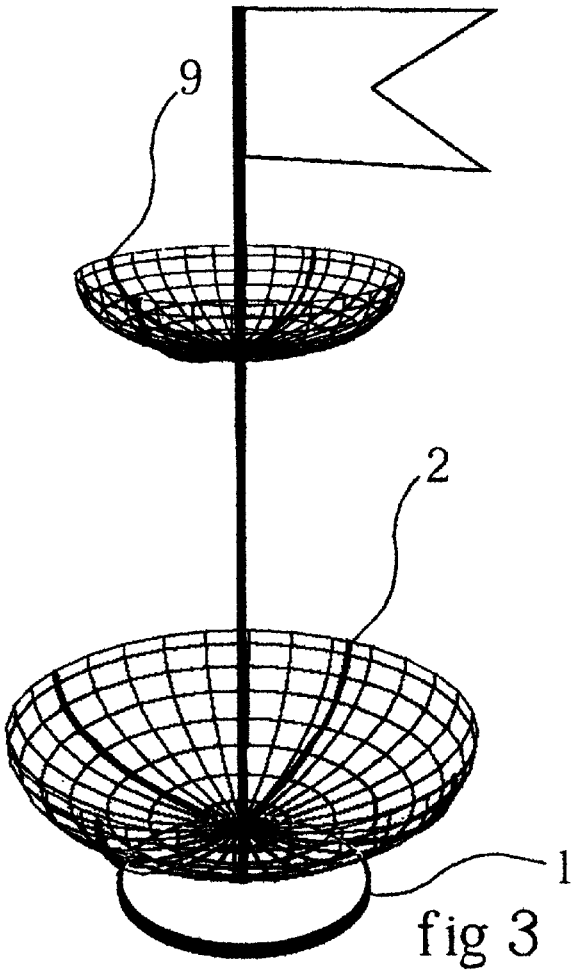
FIG. 3 is another elevation view of the Netty Millenn with the base plate assembly.
Figure 4:
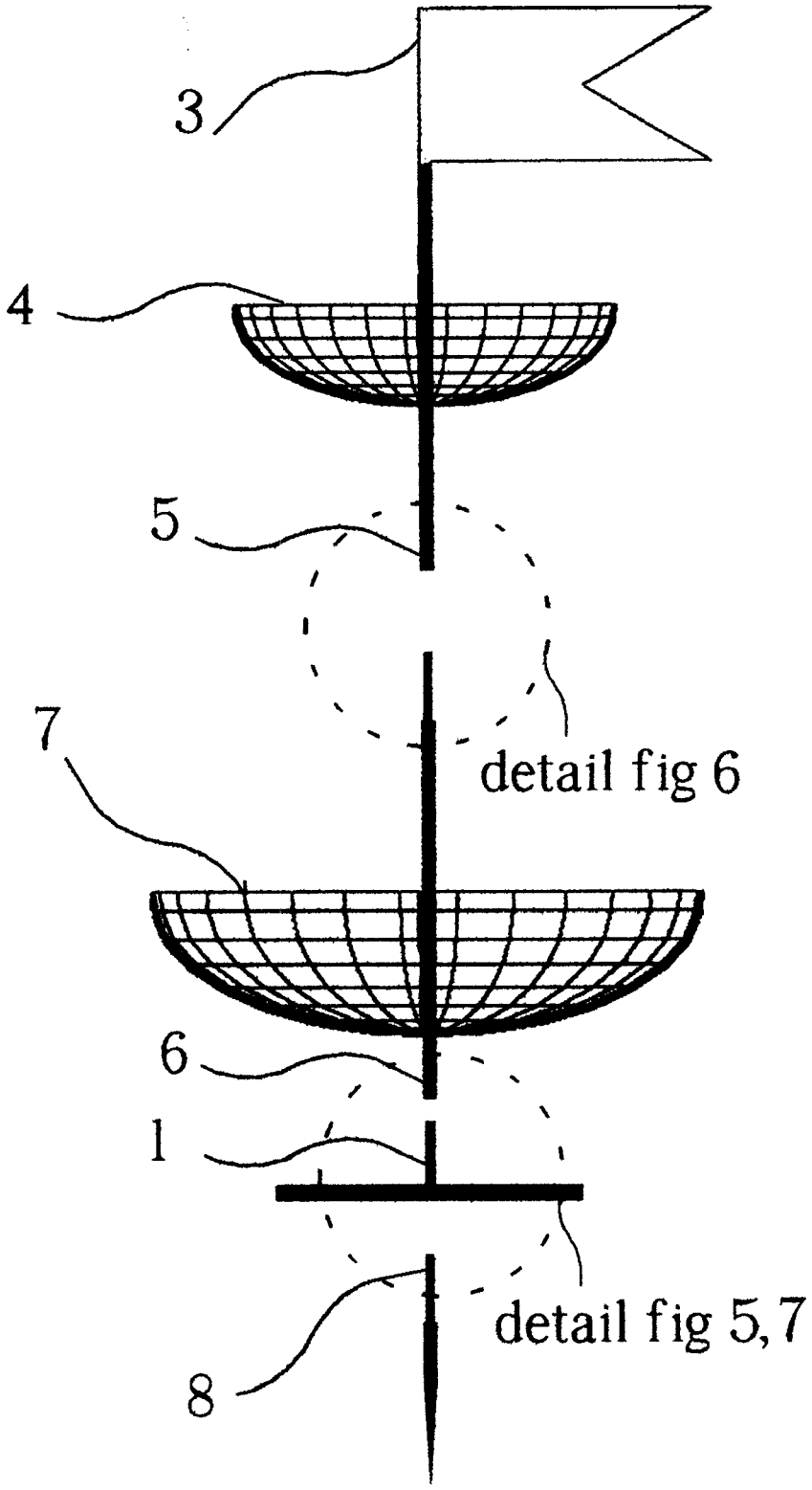
FIG. 4 is the separated or exploded version showing the parts of the Netty Millenn in the elevation view with the ground pointed spike and base plate alternatives.

Referring now to FIG. 1 through FIG. 3, these depict the general construction of the Netty Millenn with both upper and lower nets in the open position assembled on the shaft which is inserted into the base plate 1. The lower net 2 is substantially larger than the upper net 4. These nets are constructed of nylon netting material, assembled around and attached to the metal ribs 7 and 9, which are in turn attached to the upper frame tube 5 and lower frame tube 6. In FIG. 1 through FIG. 3, the base plate assembly 1 is depicted. The flag 3 is then mounted in the top of upper frame tube 5 and above the upper net 4.

In FIG. 4, again the Netty Millenn is depicted in a disassembled or exploded version with upper frame tube 5 and lower frame tube 6; upper net 4 and flag 3 are disconnected from lower frame tube 6 and base plate assembly 1. The pointed spike 8 is used when ordinary ground or turf is the location for Millenn Golf. The spine 8 is inserted into lower frame tube 6 in place of base plate assembly 1. Upper net 4 and net rib 7 are also shown.

Figure 5:
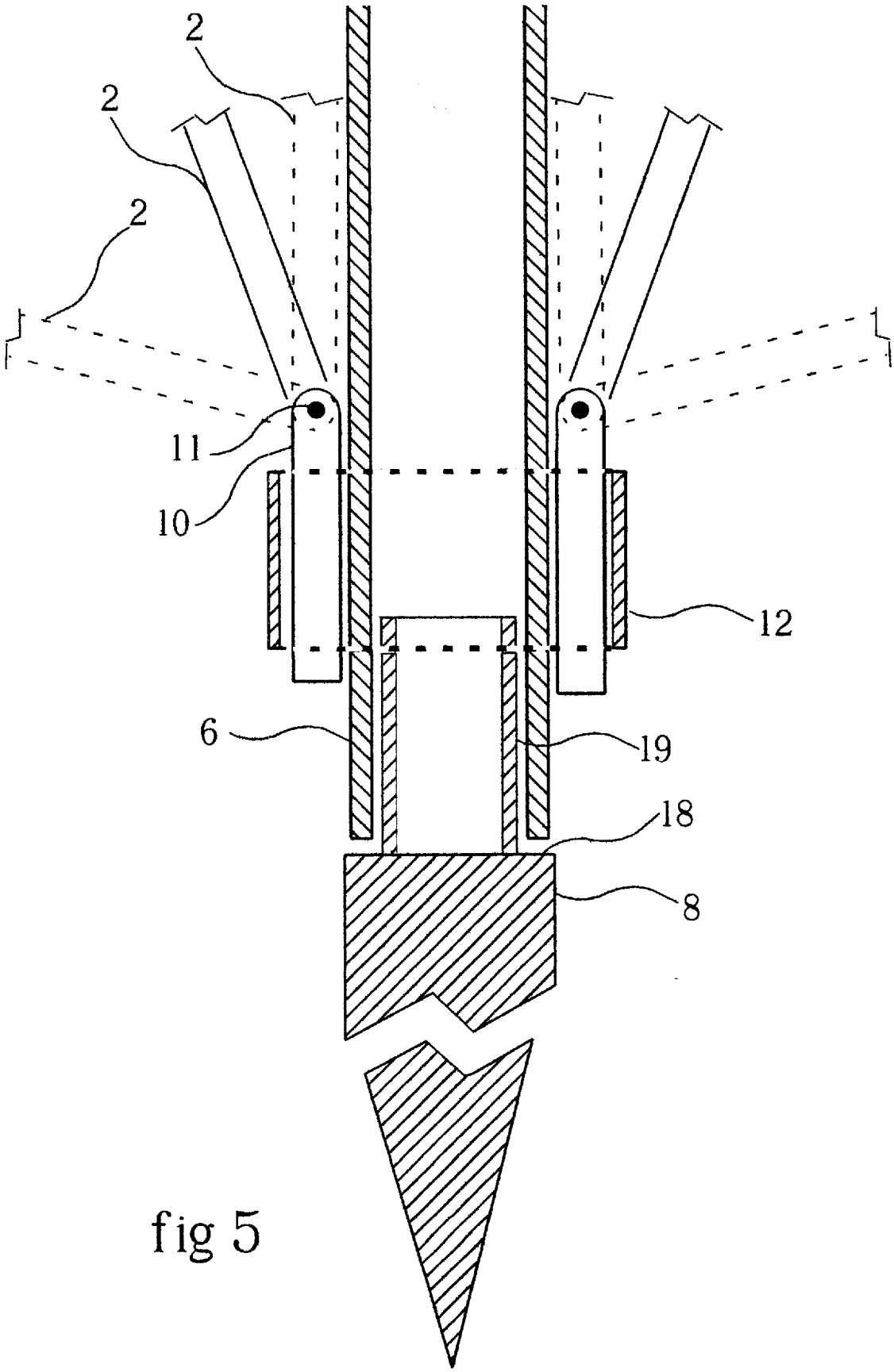
FIG. 5 is the cross-sectional view of the connection between the spike and the lower frame tube on Netty Millenn.

FIG. 5 depicts the cross-sectional detail of the lower frame tube 6, with the pointed spike assembly inserted into the base of lower frame tube 6 when pointed spike tube 19 is inserted inside the sleeve of lower frame tube 6. The assembly using spike 8 with the pointed ground spike shoulder 18 is securely fastened to lower frame tube 6 by the lower clamp 12. Lower net 2 is mounted in net rib mounting strip 10 and moves about pivot 11.

Figure 6:
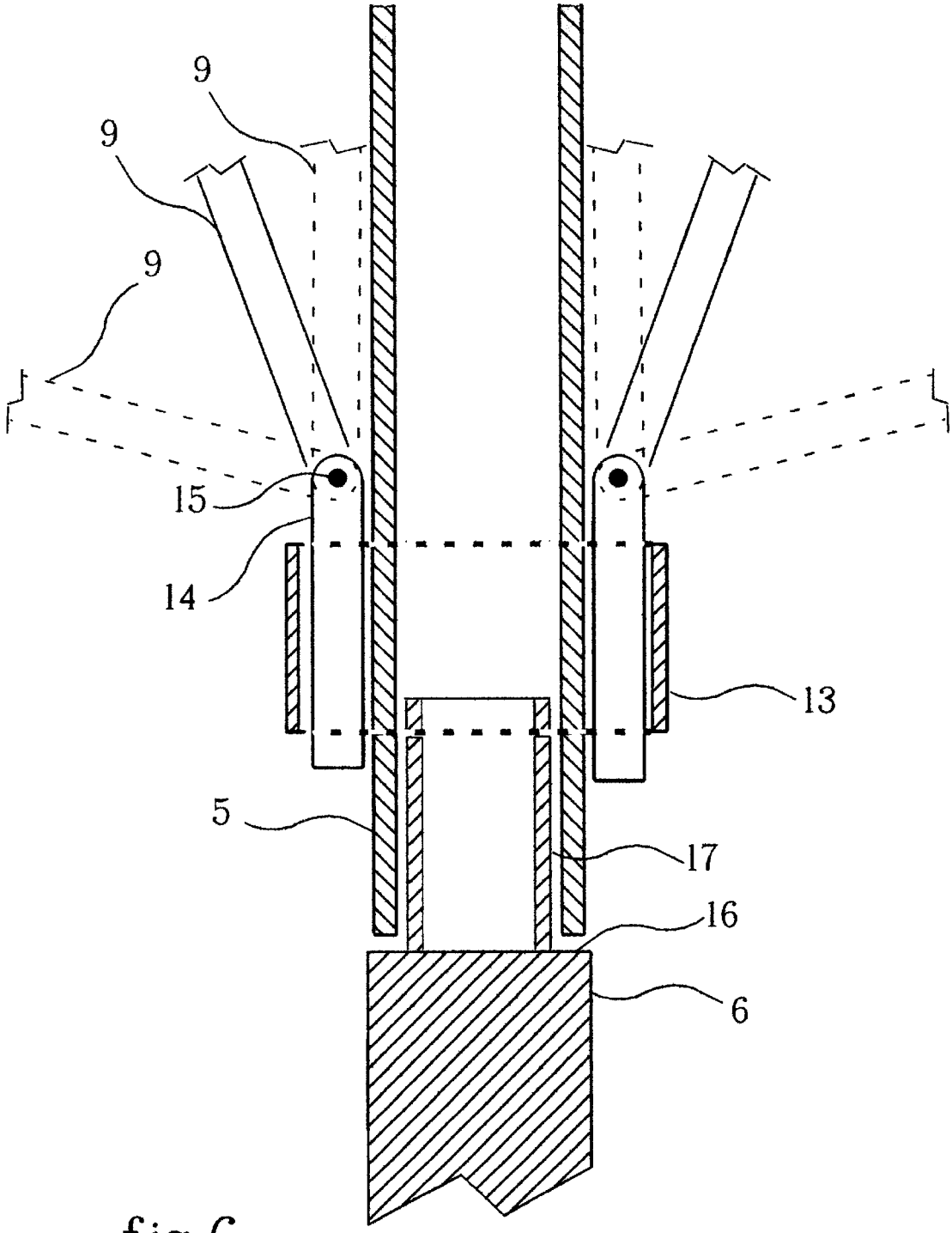
FIG. 6 is the cross-sectional view of the connection between the lower and the upper frame tubes of Netty Millenn.

FIG. 6 depicts a cross-sectional detail of the connection between upper frame tube 5 and lower frame tube 6, which are securely fastened by upper clamp 13. In this assembly detail, the lower frame tube shoulder 16 on the top of lower frame tube 6 prevents any further insertion of the lower frame tube insert tube 17 further into the base of upper frame tube 5. The upper net rib 9 is mounted in the upper net rib mounting strip 14 at pivot 15.

Figure 7:
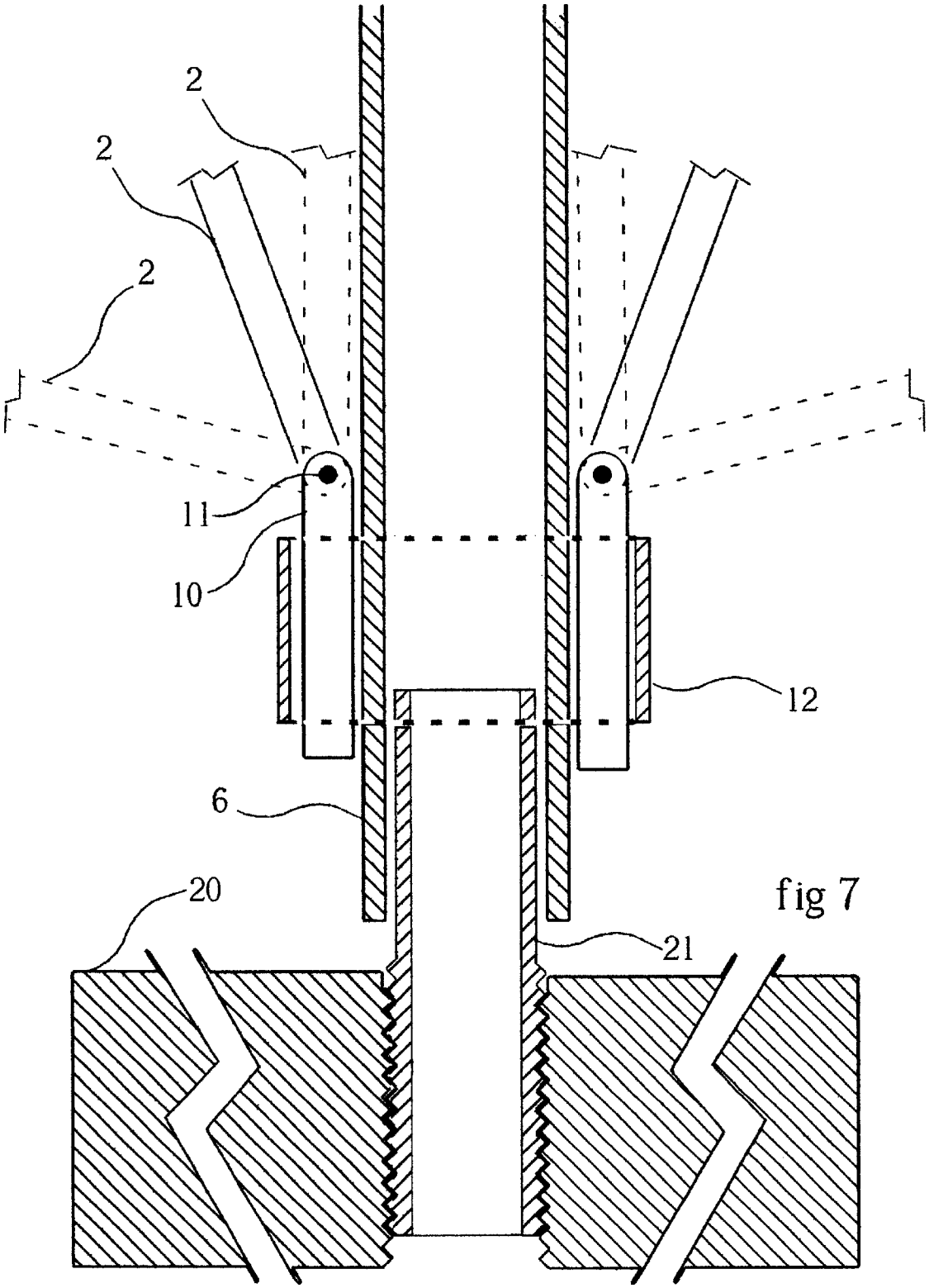
FIG. 7 is a cross-sectional view of the connection of the lower frame tube with the base plate of Netty Millenn.
Figure 8:
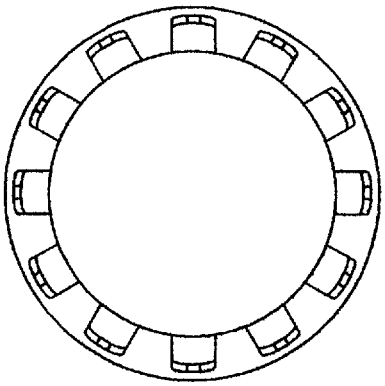
FIG. 8 is the plan view of the SC Nium Flyer.
Figure 9:
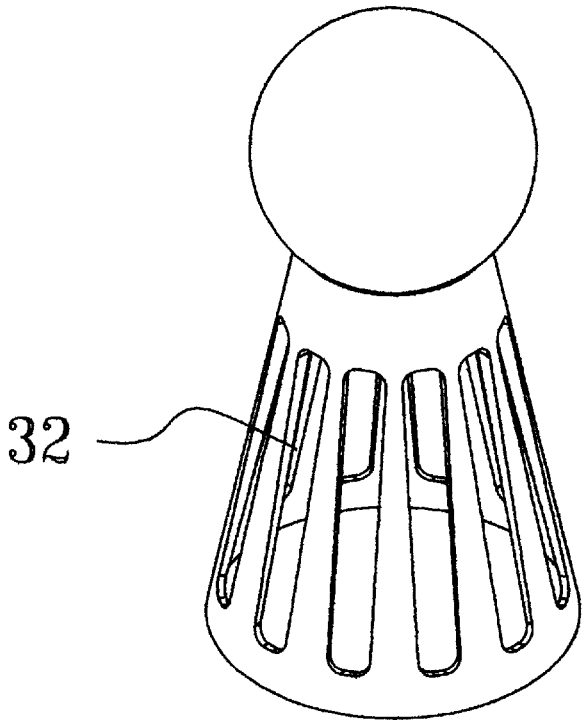
FIG. 9 is the perspective view of the SC Nium Flyer.
Figure 10:
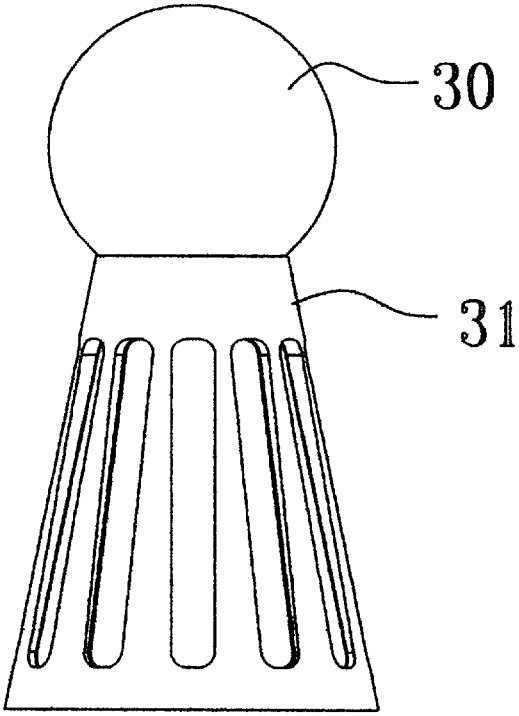
FIG. 10 is the elevation view of SC Nium Flyer.

FIG. 7 is a cross-sectional detail of the base plate assembly 1 as it attaches to the lower frame tube 6 by means of insertion of the base plate tube 21 into 6. Again, lower clamp 12 is used to securely fasten those two members together. Base plate tube 21 is threaded into base plate 20 to securely hold those two components together when the base plate assembly 1 is used in playing Millenn Golf. The net rib mounting strip 10 and pivot 11 are also located in this drawing, FIG. 7, where the lower net 2 is attached for deployment.

Figure 11:
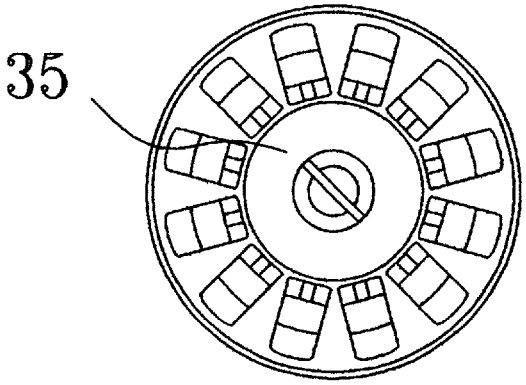
FIG. 11 is the base view of SC Nium Flyer, looking from the base of the object toward the head inside the cone of the base of SC Nium Flyer.

FIG. 8, FIG. 9, FIG. 10, FIG. 11, FIG. 12, FIG. 13, and FIG. 14 all concern SC Nium Flyer. Ball 30 is mounted on the badminton-style fairing 31 which contains numerous openings 32. In FIG. 11, the view from the base of the badminton-style fairing 31 shows the screw/shoulder screw 35 as it attaches ball 30 to badminton-style fairing 31.

Figure 12:
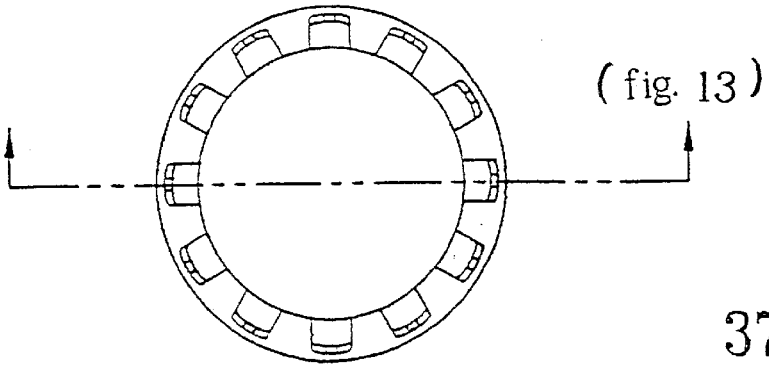
FIG. 12 is the cross-sectional location of SC Nium Flyer, plan view.
Figure 13:
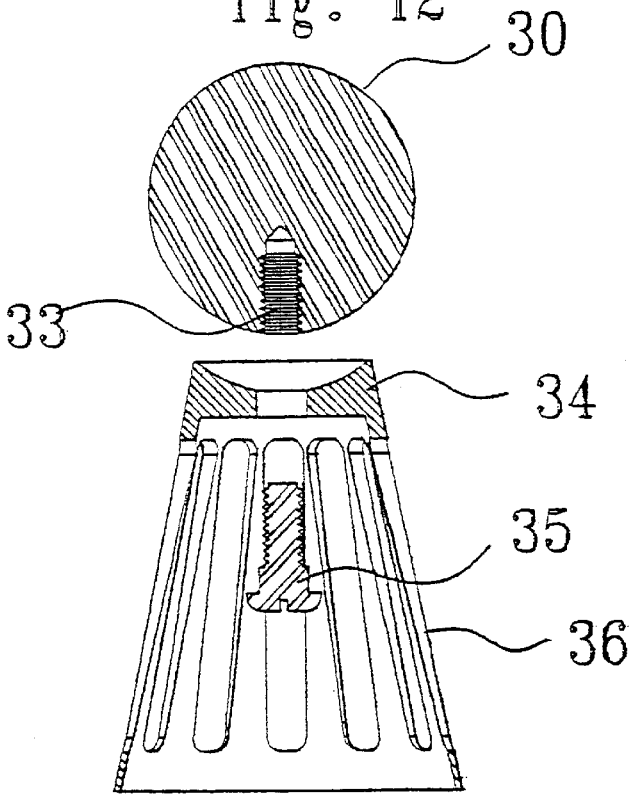
FIG. 13 is the cross-sectional view of the SC Nium Flyer head and tail section.

In FIG. 12 and FIG. 13 concerning the cross-section AA across FIG. 12, the threads 33 are bored into the ball 30. The screw/shoulder screw 35 is then screwed into threads 33 through 34, the thick base of 31. The tapered wall in 31 is identified by 36.

Figure 14:
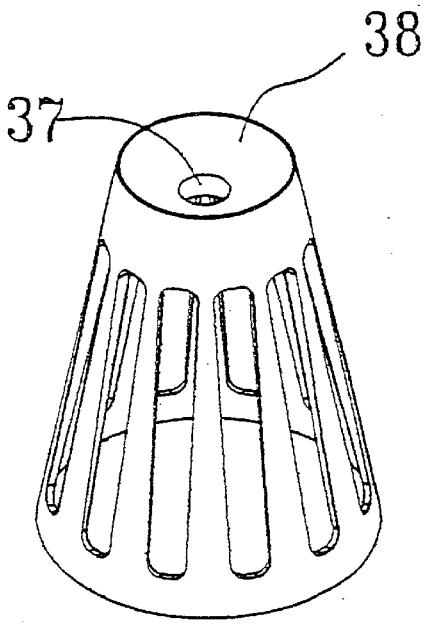
FIG. 14 is a perspective view of the tail section of SC Nium Flyer without the ball head.
Figure 15:
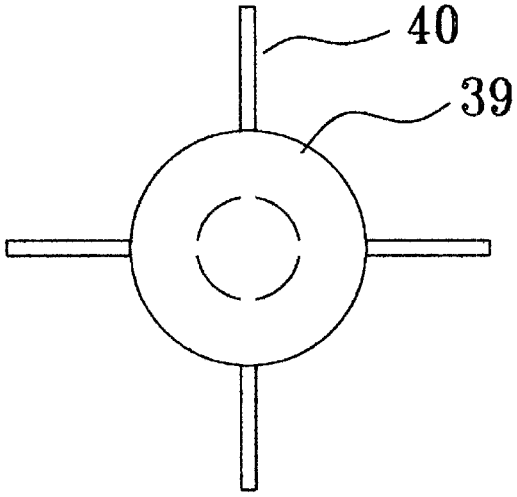
FIG. 15 is the plan view of Stealthy Nium Flyer with four wing-fins.
Figure 16:
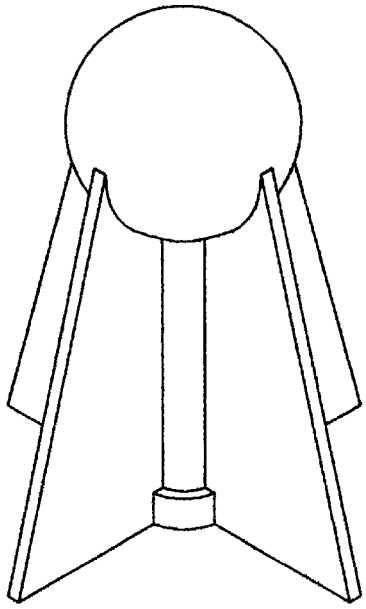
FIG. 16 is perspective view of the Stealthy Nium Flyer with four wing-fins.
Figure 17:
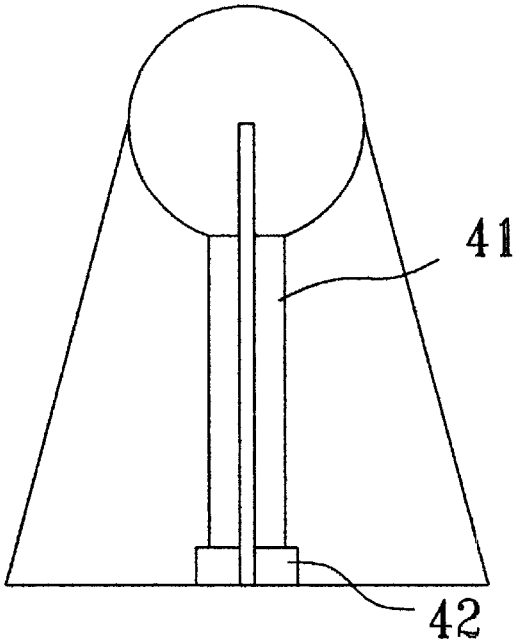
FIG. 17 is the elevation view of Stealthy Nium Flyer with four wing-fins.
Figure 18:
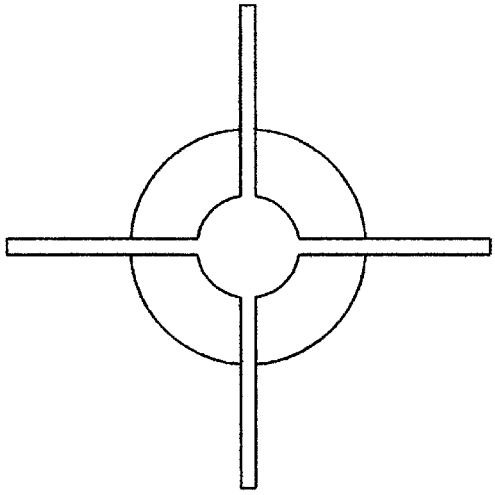
FIG. 18 is the bottom view looking toward the head of Stealthy Nium Flyer with four wings.
Figure 19:
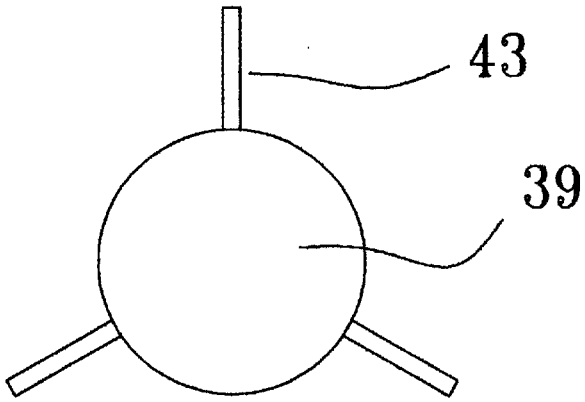
FIG. 19 is the plan view of Stealthy Nium Flyer with three wing-fins.
Figure 20:
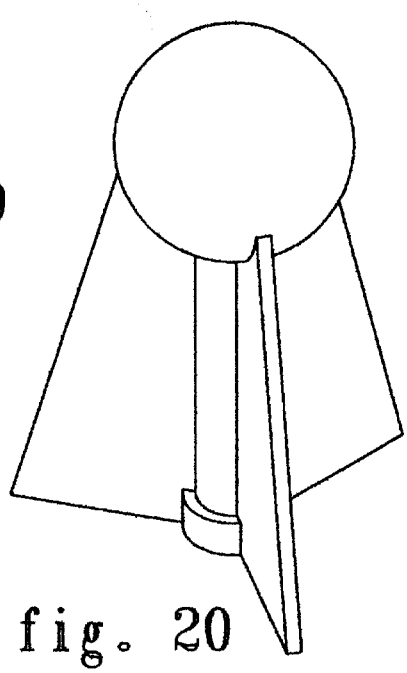
FIG. 20 is the perspective view of Stealthy Nium Flyer with three wing-fins.
Figure 21:
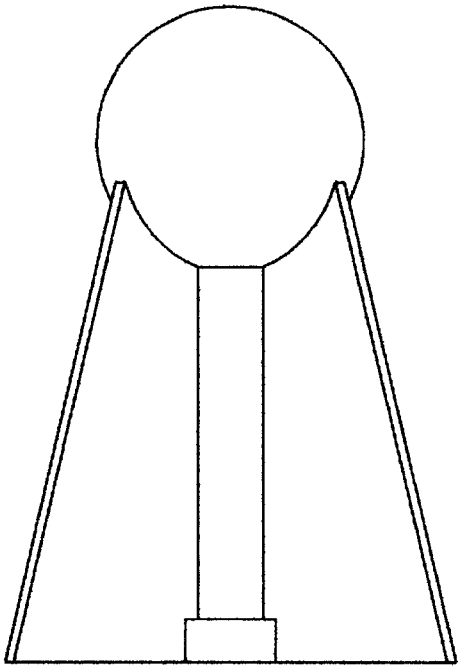
FIG. 21 is the elevation view of Stealthy Nium Flyer with three wing-fins.
Figure 22:
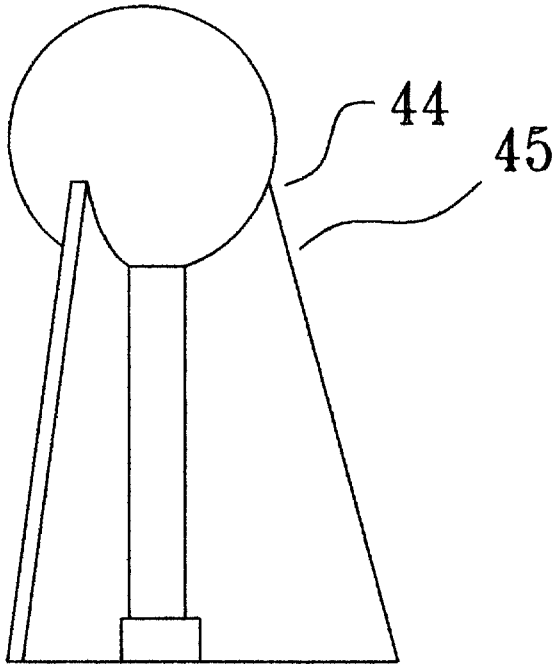
FIG. 22 is another elevation of Stealthy Nium Flyer with three wing-fins.
Figure 23:
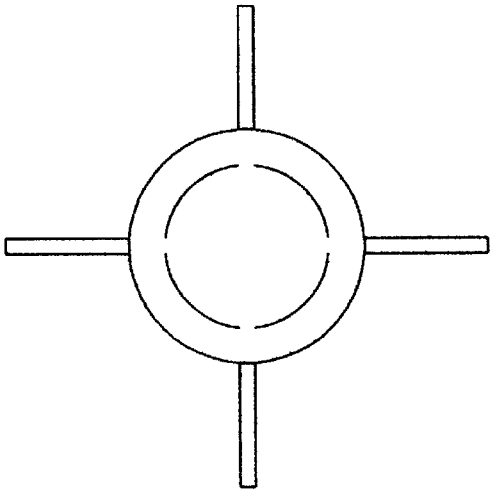
FIG. 23 is a plan view of Velo Nium Flyer with four wing-fins.
Figure 24:
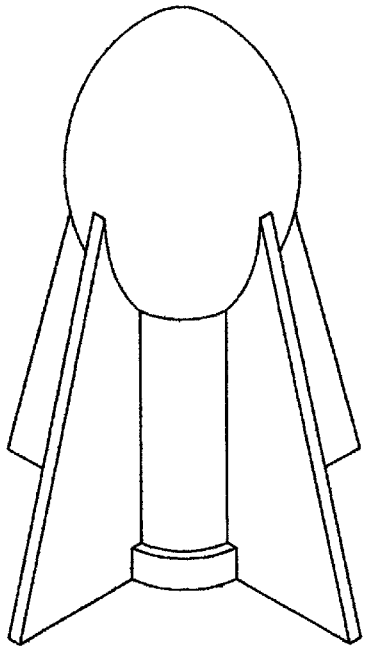
FIG. 24 is the perspective view of Velo Nium Flyer with four wing-fins.
Figure 25:
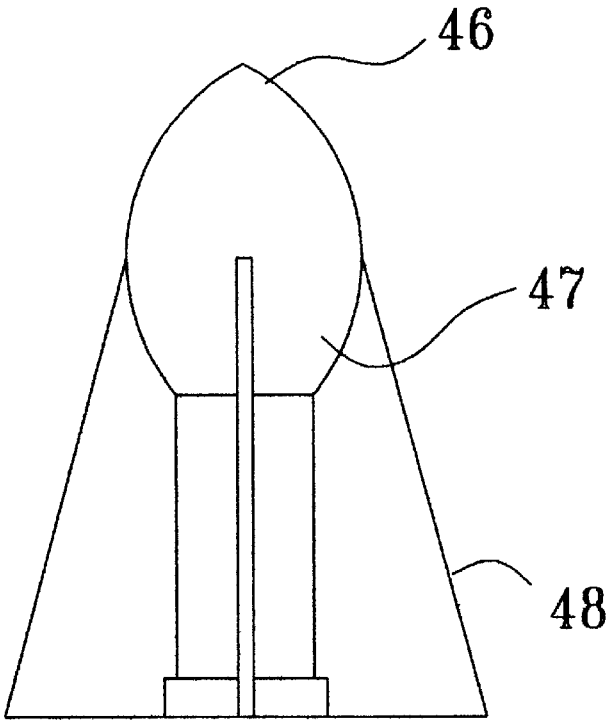
FIG. 25 is the elevation view of Velo Nium Flyer with four wing-fins.
Figure 26:
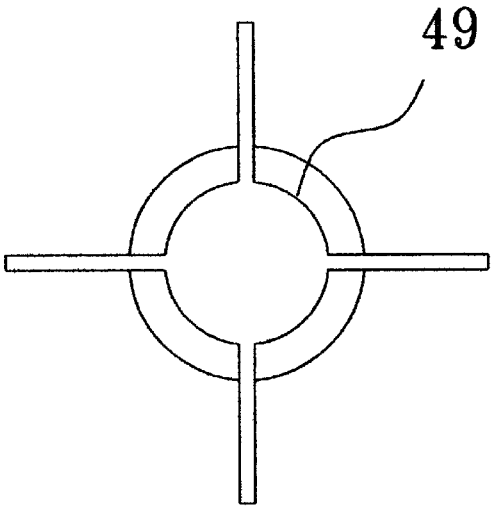
FIG. 26 is the base view of Velo Nium Flyer with four wing-fins.
Figure 27:
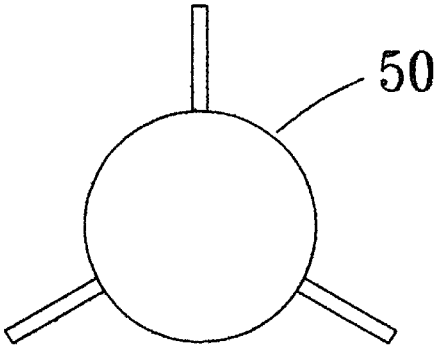
FIG. 27 is the plan view of Velo Nium Flyer with three wing-fins.

On FIG. 14, the badminton-style fairing 31 is depicted with 37, hole in 31. The spherical housing in 31 is identified at 38, which is the location on which 30 rests in the fully assembled position once screw/shoulder screw 35 is screwed into 33, the threads in 30.

FIG. 15, FIG. 16, FIG. 17, and FIG. 18 concern the Stealthy Nium Flyer with a four wing-fin arrangement 40. The unitized ball 39 is mounted on the center tube/rod 41 on the opposite end of tube/rod end 42.

FIG. 19, FIG. 20, FIG. 21, and FIG. 22 depict the Stealthy Nium Flyer with the three wing-fin assembly 43 attached to the unitized ball 39. The recess on the wing-fin edge 44 exposes more of the side, and 45 is the recessed edge on wing-fin 43.

FIG. 23, FIG. 24, FIG. 25, and FIG. 26 depict the Velo Nium Flyer with upper portion of football head 46 and lower portion of football head 47. These FIGS. 23–26 depict the Velo Nium Flyer in the four wing-fin assembly 48, which are attached to center tube/rod 49.

Figure 28:
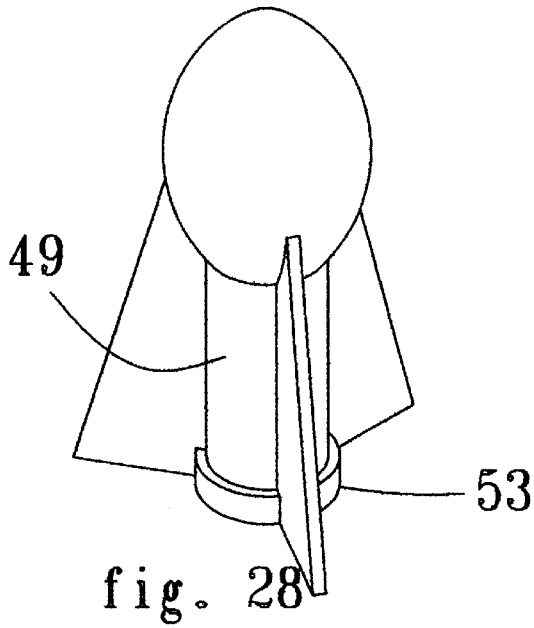
FIG. 28 is the perspective view of Velo Nium Flyer with three wing-fins.
Figure 29:
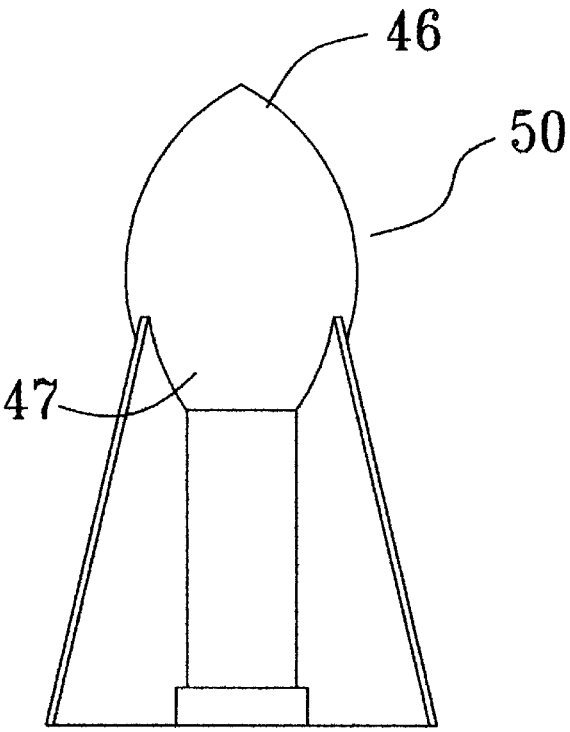
FIG. 29 is the elevation view of Velo Nium Flyer with three wing-fins.
Figure 30:
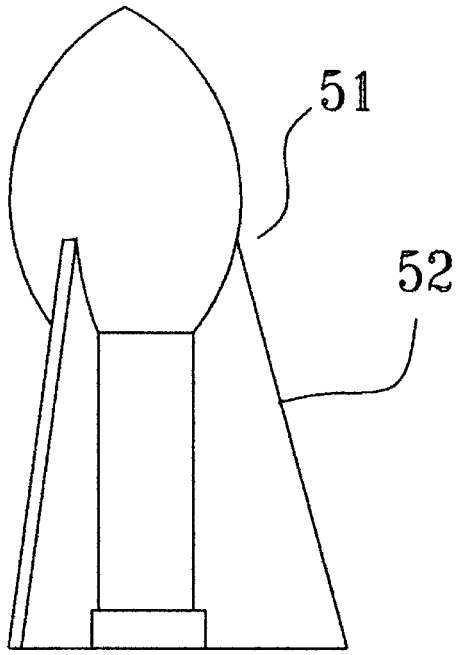
FIG. 30 is the elevation view of Velo Nium Flyer with three wing-fins.

FIG. 28, FIG. 29, and FIG. 30 depict upper football head 46 and lower portion 47 of Velo Nium Flyer with football broadside 50 resting on and mounted on center tube/rod 49. In this version of Velo Nium Flyer, a three wing-fin 52 assembly is used. The wing-fins are attached to the football broadside head 50 and are also attached at tube/rod end 53. Lower portion of football head 47 recesses at 51.

Figure 31:
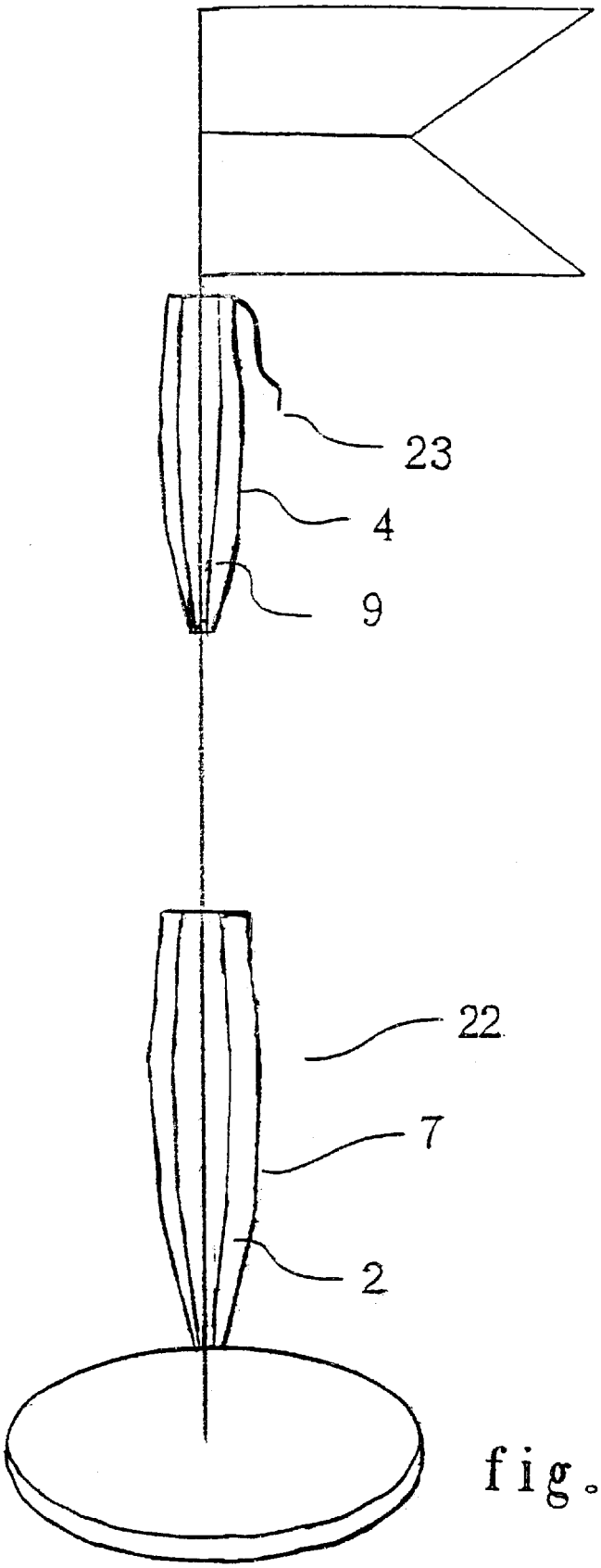
FIG. 31 is the elevation view of Netty Millenn fully assembled with the base plate assembly and Millenn Golf flag with logo.

FIG. 31 is the fully assembled Netty Millenn with the upper net 4 and lower net 2 in the collapsed position, with the upper net rib 9 and the lower net rib 7 in the folded or collapsed position. The upper net snap strap 23 is ready for closure, as is the lower net snap strap 22.

Figure 32:
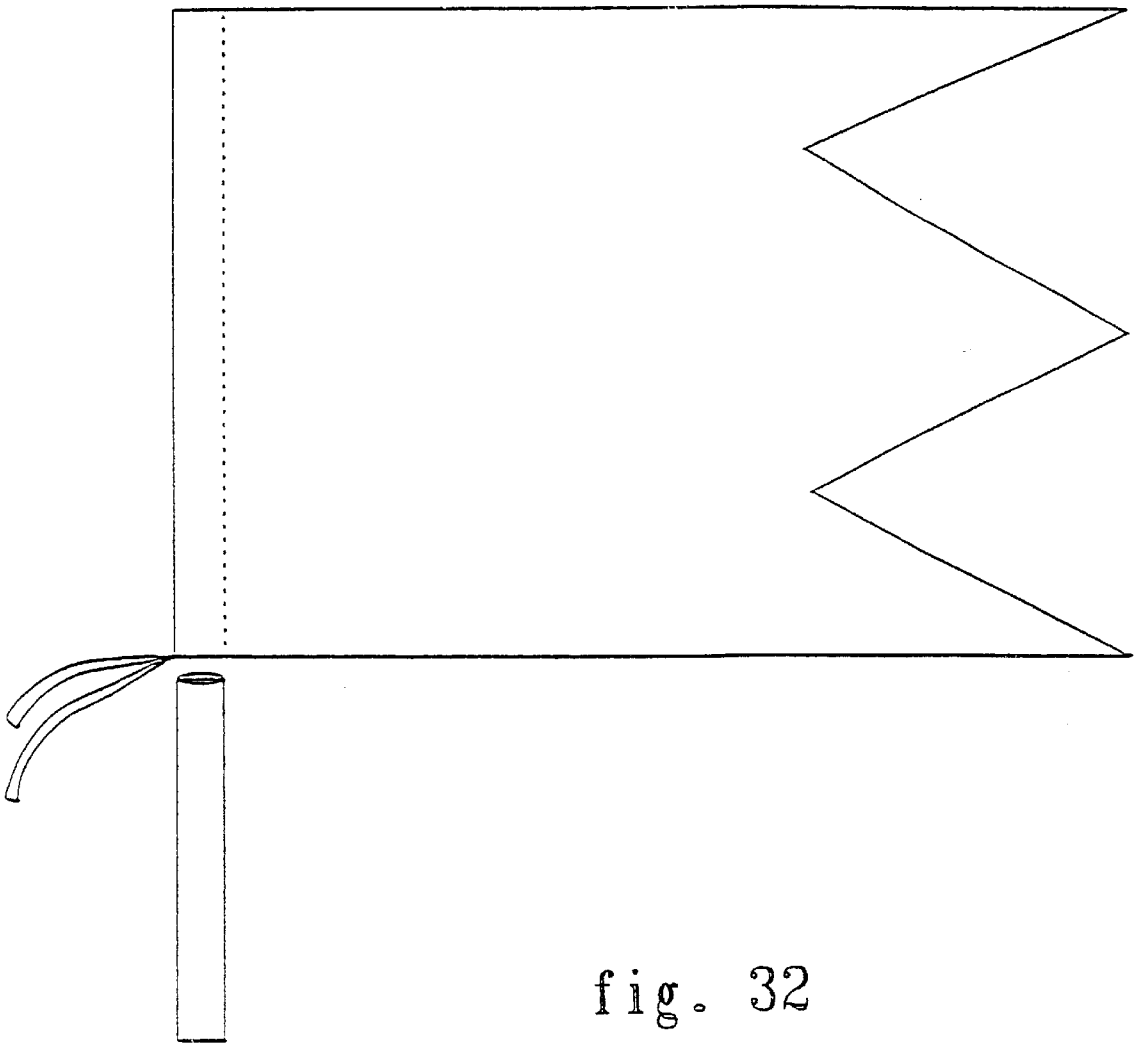
FIG. 32 is the detail of Millenn Golf flag logo.

FIG. 32 is the Millenn Golf flag logo which appears on either white, orange, or green flag.

Figure 33:
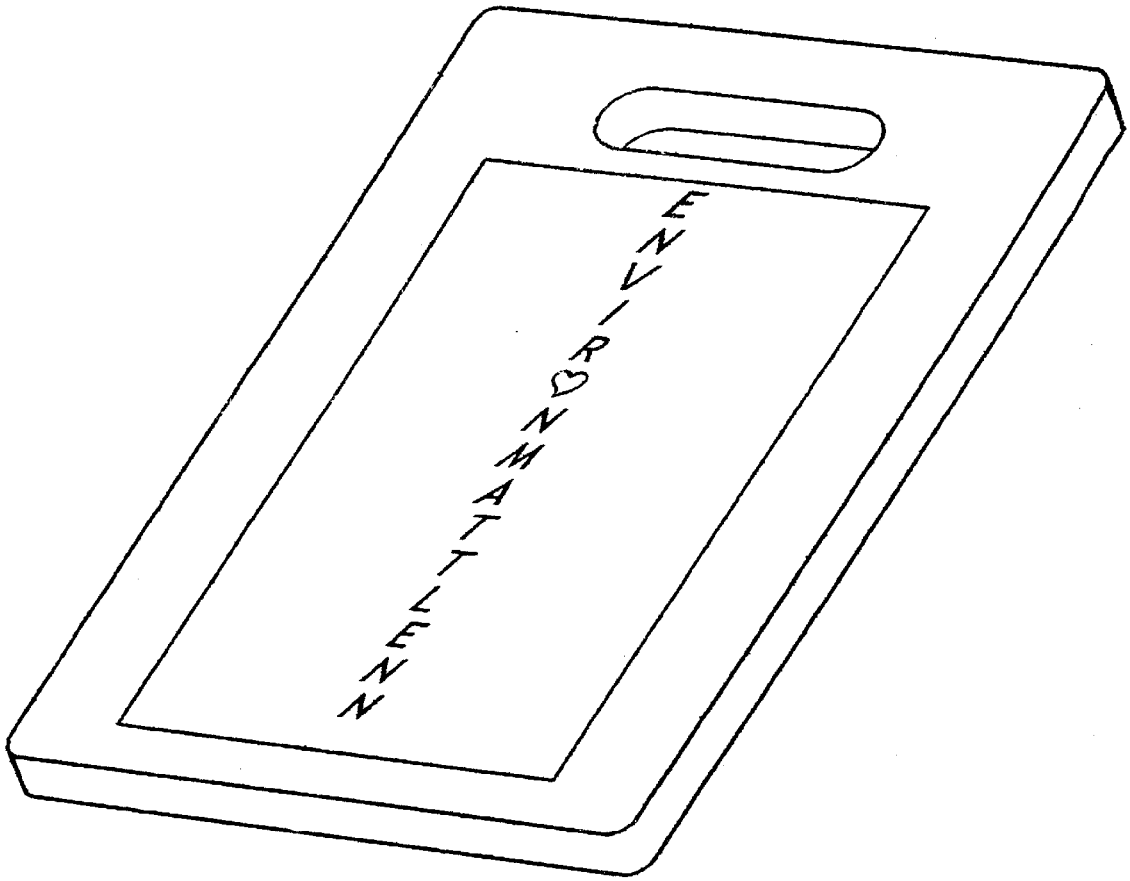
FIG. 33 is the perspective view of ENVIR♡NMATTLENN with white English letters down the center.

FIG. 33 is the ENVIR♡NMATTLENN strip of indoor-outdoor synthetic turf or carpet on which appears down the centerline the word ENVIR♡NMATTLENN in white letters on the synthetic turf mat used in Millenn Golf. The mat measures 400 mm×200 mm×20 mm.

Figure 34:
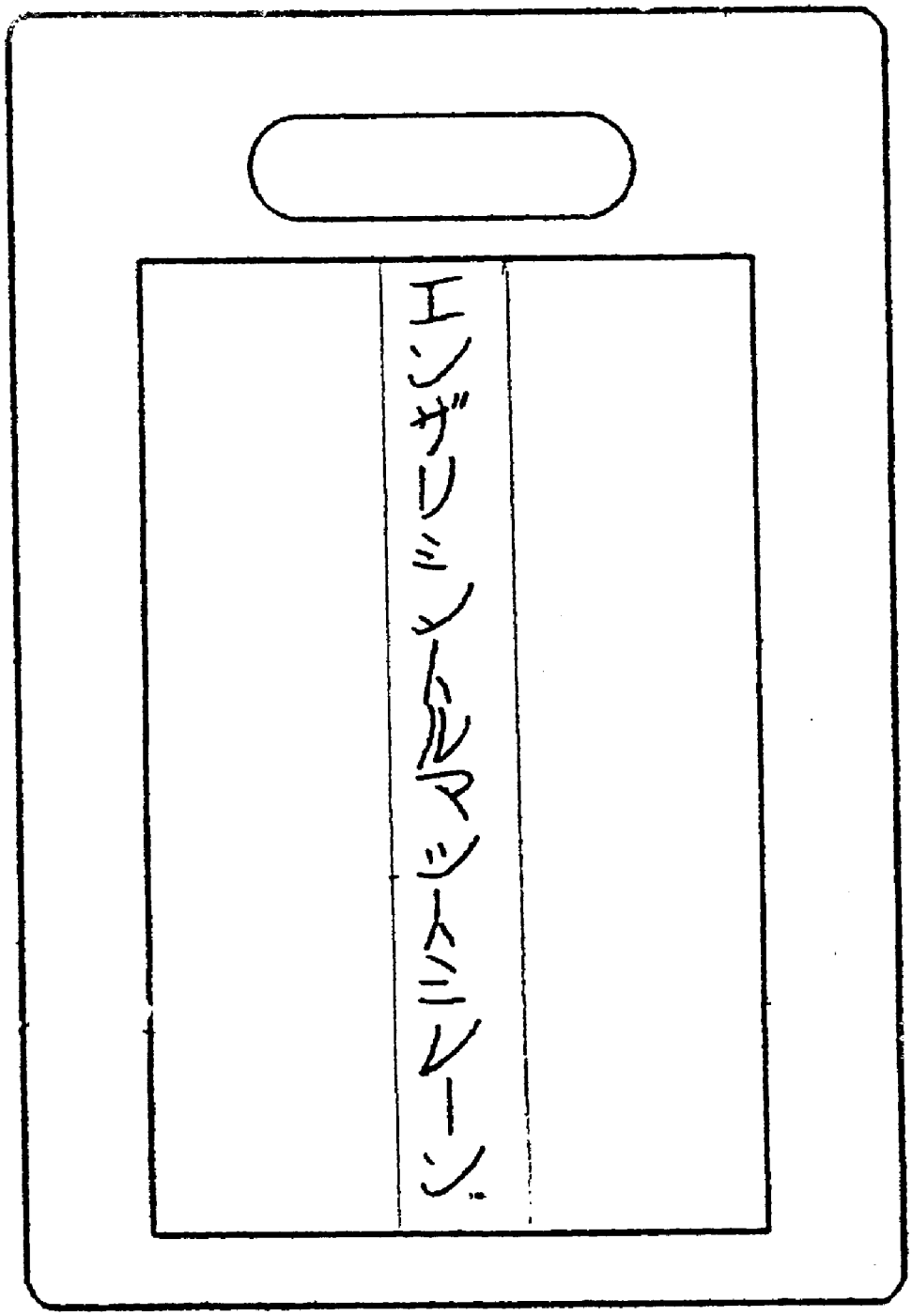
FIG. 34 is the perspective view of ENVIR♡NMATTLENN with white Japanese katakana down the center.

FIG. 34 is another drawing of ENVIR♡NMATTLENN with the Japanese katakana down the centerline of the ENVIR♡NMATTLENN. Again, this mat is the Japanese version of ENVIR♡NMATTLENN using white letters down the centerline of the synthetic turf mat used in playing Millenn Golf.

RULES OF MILLEN GOLF

In Millenn Golf, each player uses an ordinary golf club to strike the Nium Flyer from a portable strip of synthetic turf, ENVIR♡NMATTLENN, causing the Nium Flyer to soar into the air toward or into the Netty Millenn in the fewest strikes of the Nium Flyer with the golf club as possible until the Nium Flyer lands into and rests in the Netty Millenn. Each player then removes the Nium Flyer from the Netty Millenn and proceeds to repeat the game process to any number of Netty Millenn in the course as determined by the players or the game master for the day. The player with the fewest strokes, as in regular golf, is the winner of that particular match or event. Alternatively, points may be used and assigned for successfully landing the Nium Flyer in the upper or lower Netty Millenn, depending upon the particular game chosen at that time by the players or game master. The course may consist of one or more Netty Millenn as desired and deemed necessary by the players and/or the game master for the day or that particular event.

The players choose from any one of four Nium Flyers in playing Millenn Golf. In Millenn Golf, the players use only two clubs, a driver and/or a lofted iron, to strike the Nium Flyer chosen for that particular game or portion of the course. The players use either a driver or an ordinary lofted golf club in striking the Nium Flyer which must rest on ENVIR♡NMATTLENN at the start of each stroke by the player. After the stroke is played, the player then carries the ENVIR♡NMATTLENN to the location of the Nium Flyer, places the Nium Flyer on the synthetic turf, and repeats the process until the Nium Flyer comes to rest in the netting of the Netty Millenn.

The players or the game master decides which Nium Flyer is to be used for a particular game. The players or the game master decides the number of points given for the goal achieved before the game starts. All players must first agree on the rules, points, and scoring for that particular game before starting. If the players cannot agree, the game master decides the rules applicable and decides all scoring disputes and rule contests. The players are responsible for their own correct scoring records. A player may be disqualified by the game master for incorrect scoring records.

What is claimed is new and desired to be protected by Letters Patent is set forth in the appended claims:

1. Equipment for use in a portable golf game, comprising:

a golf club;

a ball having an upper section and a lower section with a plurality of vane members extending outwardly therefrom;

an upstanding support having upper and lower ends;

a lower dish-shaped net having a center, upper and lower end portions, and an opening formed in said upper end portion; said center of said lower dish-shaped net being mounted on said support; and an upper dish-shaped net having a center, upper and lower end portions, and an opening formed in said upper end portion; said center of said upper dish-shaped net being mounted on said support above said lower dish-shaped net; said opening of said upper dish-shaped net having a smaller diameter than the diameter of the opening in said lower dish-shaped net;

said upper and lower dish-shaped nets being selectively collapsible with respect to said upstanding support.

2. The equipment of claim 1 wherein said center of said upper and lower dish-shaped nets are removably mounted on said upstanding support.

3. The equipment of claim 1 wherein said sections of said ball are semi-hemispherical.

4. The equipment of claim 1 wherein said upper section of said ball is generally parabolic-shaped.

5. The equipment of claim 1 wherein said vane members have a generally triangular shape.

6. The equipment of claim 5 wherein each of said vane members includes an inner edge having upper and lower ends, a lower edge having inner and outer ends, and an outer edge extending upwardly and inwardly from said outer end of said lower edge toward said lower section.

7. The equipment of claim 6 wherein said vane members are operatively connected to one another adjacent their inner edges.

8. The equipment of claim 6 wherein said ball is further provided with an elongated rod having first and second ends and side portions; said first end of said rod being operatively connected to said lower section and the inner edges of said vane members being operatively connected to the side portions of said rod.

9. The equipment of claim 1 wherein said ball has an outer surface having a plurality of depressions formed therein.

10. The equipment of claim 1 wherein said golf club is a lofting iron.

11. The equipment of claim 1 wherein said golf club is a driver.

12. The equipment of claim 1 further comprising a portable mat adapted for supporting a ball thereon in a starting position.

13. The equipment of claim 12 wherein said portable mat is at least partially comprised of artificial turf.

* * * * *